US005235298A

United States Patent [19]

Banno et al.

[11] Patent Number: 5,235,298

[45] Date of Patent: Aug. 10, 1993

[54] TEMPERATURE COMPENSATED STRIPLINE FILTER FOR MICROWAVES

[75] Inventors: Hisao Banno; Masahiro Nishiki, both of Nagoya, Japan

[73] Assignee: NGK Spark Plug Co., Ltd., Aichi, Japan

[21] Appl. No.: 655,377

[22] PCT Filed: Jul. 6, 1990

[86] PCT No.: PCT/JP90/00871

§ 371 Date: Mar. 7, 1991

§ 102(e) Date: Mar. 7, 1991

[87] PCT Pub. No.: WO91/01047

PCT Pub. Date: Jan. 24, 1991

[30] Foreign Application Priority Data

Jul. 7, 1989 [JP] Japan ..... 1-176715

[51] Int. Cl.[5] ..... H01P 1/203; H01P 1/30

[52] U.S. Cl. ..... 333/204; 333/234

[58] Field of Search ..... 333/202-205, 333/246, 234

[56] References Cited

U.S. PATENT DOCUMENTS

Re. 31,470 12/1983 Bedand et al. ..... 333/203 X
3,798,578 3/1974 Konishi et al. ..... 333/229
3,840,828 10/1974 Linn et al. ..... 333/204 X
4,940,955 7/1990 Higgins, Jr. ..... 333/234 X

FOREIGN PATENT DOCUMENTS 0018274 7/1970 Japan .
0100058 5/1988 Japan .
0110618 5/1988 Japan .

*Primary Examiner*—Robert J. Pascal
*Assistant Examiner*—Seung Ham
*Attorney, Agent, or Firm*—Larson and Taylor

[57] ABSTRACT

The present invention is to overcome a problem of a variation in a resonant frequency of a microwave stripline filter which may occur at a change of temperature during when the microwave stripline filter is operated. The microwave stripline filter has resonator electrodes (3 and 4) with a predetermined pattern provided between a pair of dielectric substrates (1 and 2), one of the dielectric substrates is formed by ceramic material whose temperature coefficient of resonant frequency is negative, and the other substrate is formed by a ceramic material whose temperature coefficient of resonant frequency is positive, which results in that the mutual temperature dependency to the resonant frquency in the paired dielectric substrates can be cancelled, and thus it is possible to feasibly hold the temperature coefficient of the filter device to zero. The stripline filter according to the present invention can conveniently utilized as a band-pass filter for miniature electronic circuits.

4 Claims, 2 Drawing Sheets

TEMPERATURE COMPENSATED STRIPLINE FILTER FOR MICROWAVES

TECHNICAL FIELD

The present invention relates to a temperature compensated microwave stripline filter which may be used as a band-pass filter for a microwave range for example.

BACKGROUND ART

There is known a microwave stripline filter in which it comprises a pair of dielectric ceramic substrates between which one or more resonator conductors are disposed in a predetermined pattern to form a resonator. In such a microwave stripline filter, one or more resonator conductors having a length corresponding to a predetermined resonant frequency are provided on each of the opposite inner surfaces of the paired dielectric ceramic substrates, a ground conductor is provided on the outer surface of the each dielectric ceramic substrate, and the dielectric ceramic substrates are superimposed and fixed to each other so that the resonator conductors provided on the inner surfaces thereof are integrally connected to each other. Such a stripline filter for microwaves is disclosed in U.S. Pat. Nos. 4,157,517 and 4,266,206 for example. Similar stripline filters can also be found in U.S. Pat. No. 4,785,271 and Japanese Patent Prepublication No. 62-263702.

With the microwave stripline filter of the abovementioned type, generally, each dielectric ceramic substrate is made of ceramic material such as $BaO\text{-}TiO_2$, $BaO\text{-}TiO_2$-rare earth or the like.

However, there is disadvantage that the commonly used ceramic material has a resonant frequency which is decreased as the temperature is risen because the temperature coefficient of the resonant frequency is of a negative characteristic.

It is therefore an object of the present invention to provide a stripline filter for microwaves wherein the disadvantage in the conventional filter can be overcome, any variation in temperature which may occur during the operation of the filter can be compensated so as to reduce the variation of a resonant frequency.

DISCLOSURE OF THE INVENTION

According to the present invention, there is provided a microwave stripline filter having a pair of dielectric substrates which are stacked to each other, each substrate being provided with a ground electrode on the outer surface and if necessary on the peripheral surface thereof, and resonant electrodes which are positioned between the stacked surfaces of the substrates and have a predetermined pattern, characterized in that one of the dielectric substrates is formed by ceramic material having a negative temperature coefficient of resonant frequency, and the other substrate is formed by a ceramic material having a positive temperature coefficient of resonant frequency.

The paired dielectric substrates may be constructed by a combination of materials which have same composition but the negative temperature coefficient and the positive temperature coefficient, respectively.

Alternatively, the paired dielectric substrates may be constructed by a combination of materials which have different compositions, and the negative temperature coefficient and the positive temperature coefficient, respectively.

In the thus constructed microwave stripline filter according to the present invention, the paired dielectric substrates have reverse resonant frequency-temperature characteristices, respectively, and as a result, any variations of the resonant frequency in the respective substrates, which may occur at any variation in temperature during the operation of the filter, can be compensated with each other. Therefore, the filter can be stably operated without any influence of the variation in temperature.

PREFERRED FORMS BY WHICH THE INVENTION IS TO BE EXECUTED

The present invention will now be in more detail described with reference to the accompanied drawings.

Figure 1:
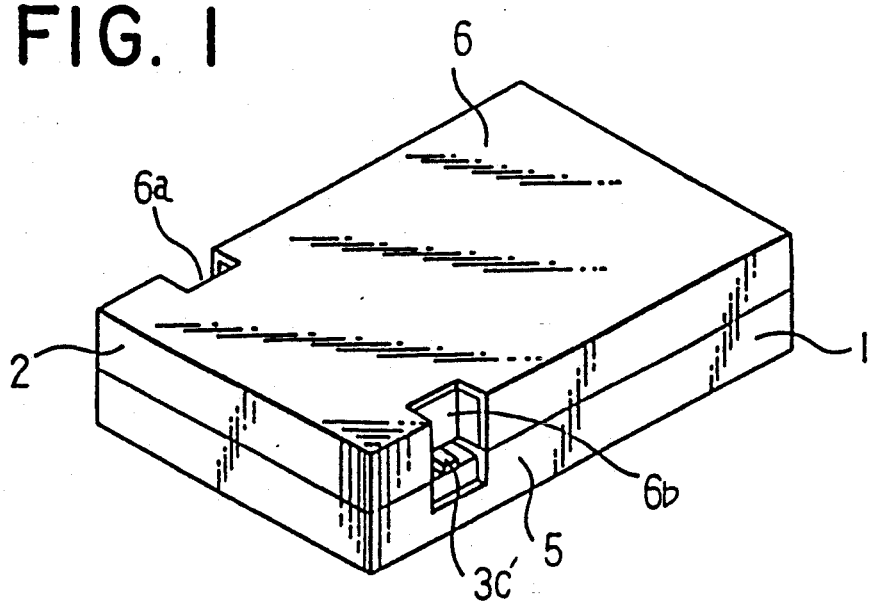
FIG. 1 is a perspective view showing a completed microwave stripline filter according to one embodiment of the present invention.
Figure 2:
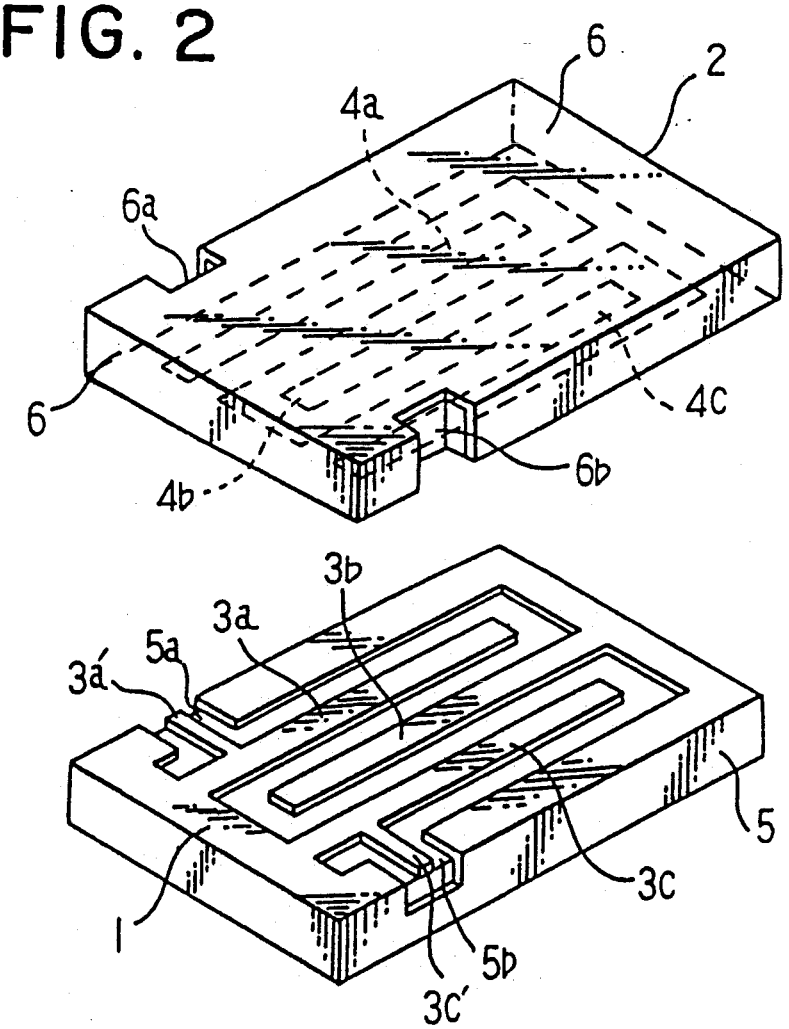
FIG. 2 is an exploded perspective view showing a pair of dielectric substrates which form the stripline filter shown in FIG. 1.

FIGS. 1 and 2 illustrate a stripline filter for microwaves according to an embodiment of the present invention. The illustrated filter comprises a first dielectric substrate 1 and a second dielectric substrate 2 which are assemblied by superimposing them to each other. On each of the opposite inner surfaces of the first and second dielectric substrate 1 and 2 there are provided three resonator electrodes 3*a*, 3*b* and 3*c*, and 4*a*, 4*b* and 4*c* with the same pattern, respectively. Each resonator electrode has a length corresponding to a predetermined resonant frequency. The dielectric substrates 1 and 2 are provided with external ground conductor layers 5 and 6 on the outer and peripheral surfaces, respectively. In this connection, the resonator electrodes 3*a*, 3*b* and 3*c*; 4*a*, 4*b* and 4*c*, and the external ground conductor layers 5 and 6 may be formed by using a suitable method such as a plating or a deposition.

As will be seen in FIG. 2, each of the resonator electrodes 3*a*, 3*b* and 3*c*; 4*a*, 4*b* and 4*c* has one end connected to the external ground conductor layers 5 and 6, and the other end spaced from the edge portions of the external ground conductor layers 5 and 6. Therefore, the resonator electrodes 3*a*, 3*b* and 3*c*; 4*a*, 4*b* and 4*c* are disposed in an interdigitated shape or a comb shape on the inner surfaces of the dielectric substrates 1 and 2, respectively.

Further, the resonator electrodes 3*a* and 3*c* of the three resonator electrodes 3*a*, 3*b* and 3*c* provided on the inner surface of the first dielectric substrate 1 are respectively provided with lateral extensions 3*a*' and 3*c*' which form an input terminal and an output terminal, respectively. These lateral extensions 3*a*' and 3*c*' are positioned at notches 5*a* and 5*b* provided on the external ground conductor layer 5. The second dielectric substrate 2 is removed together with the external conductor layer 6 at the portions corresponding to the notches 5*a* and 5*b* on the first dielectric substrate 1 thereby providing grooves 6*a* and 6*b*. When the first and second dielectric substrate 1 and 2 are assemblied, the input and output terminals 3a' and 3c' are maintained so that they do not come contact with the ground conductor layers 5 and 6. Also, the input and output terminals 3a' and 3c' can be easily connected with lead conductors not shown.

Figure 3:
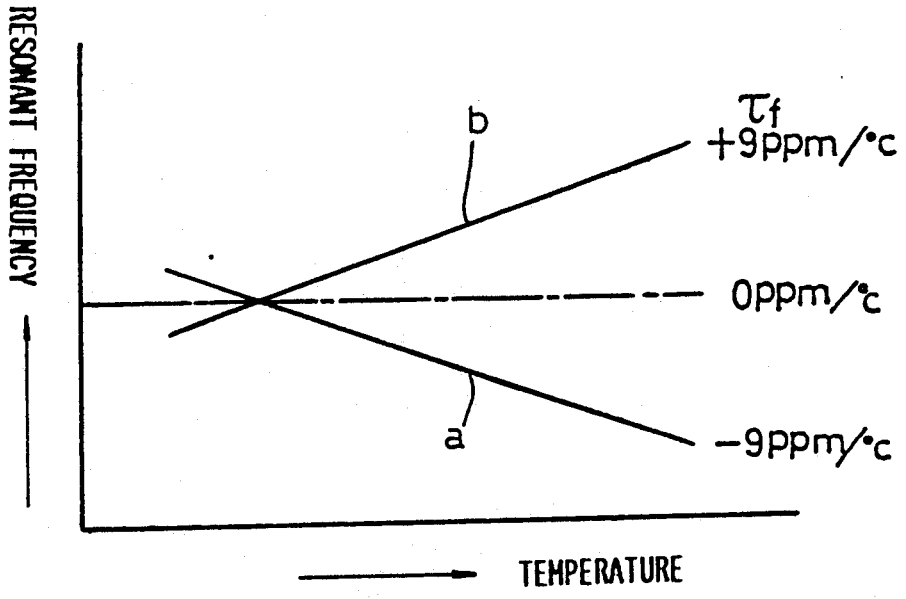
FIG. 3 is a graph of a temperature characteristic showing how the temperature coefficient of resonant frequency in the stripline filter according to present invention may be changed by the variation of the temperature.

The first dielectric substrate 1 is made of ceramic material having a characteristic that the temperature coefficient of resonant frequency, $\tau f$, is negative as shown by a reference "a" in FIG. 3, and the second dielectric substrate 2 is made of ceramic material having a characteristic that the temperature coefficient of resonant frequency, $\tau f$, is positive as shown by a reference "b" in FIG. 3.

Now, for example, for the material of the first dielectric substrate 1 there was used a dielectric ceramic material having a composition represented by $xBaO.yTiO_2.zNd_2O_3+wY_2O_3$ [x=18.1 mole %, y=10.8 mole %, z=71.1 mole % and w=9.8 weight %], a specific inductive capacity of 78.6 and a temperature coefficient of resonant frequency, $\tau f=-9$ppm/°C., and for the material of the second dielectric substrate 2 there was used a dielectric ceramic material having a composition represented by $xBaO.yTiO_2.zNd_2O_3+wY_2O_3$ [x=18.0 mole %, y=11.6 mole %, z=70.4 mole % and w=8.7 weight %], a specific inductive capacity of 78.6 and a temperature coefficient of resonant frequency $\tau f=+9$ ppm/°C. These materials were worked into the structures shown in FIGS. 1 and 2 which in turn were assemblied to each other to form a stripline filter.

Then by measuring the characteristic of the thus formed stripline filter, it was found that the filter had synthetically the specific inductive capacity more than 78 and the temperature coefficient $\tau f$ of approximately 0 as shown by dotted line in FIG. 3.

With the use of such stripline filter, if the temperature coefficient $\tau f$ thereof lies in the range of 0±5 ppm/°C., it is efficient compared with the conventional filter. Therefore, materials each having a predetermined temperature coefficient can be combined so that the above mentioned temperature coefficient range may be obtained. In this connection, it should be appreciated that the temperature coefficients of the first and second dielectric substrates are not necessarily equal to each other at an absolute value.

Also, in the illustrated embodiment, the first and second dielectric substrates 1 and 2 are formed by the combination of two ceramic materials which have the same composition but have the negative temperature coefficient and the positive temperature coefficient, respectively. However, the first and second dielectric substrates 1 and 2 may be formed by the combination of two ceramic materials which have different compositions and have the negative temperature coefficient and the positive temperature coefficient, respectively.

Furthermore, the illustrated embodiment is described with respect to the filter arrangement in which the resonator electrodes each having a predetermined pattern are disposed on the opposite inner surfaces of the paired dielectric substrates, respectively, and the paired dielectric substrates are integrally assemblied by superimposing and fixing them to each other. It should, however, be understood that the present invention can be adapted to other microwave stripline filter so arranged that resonator electrodes having a predetermined pattern are interposed between a pair of dielectric substrates which are stacked and fixed to each other.

INDUSTRIAL APPLICABILITY

As described above, according to the present invention since the first and second dielectric substrates to be superimposed are formed by the combination of materials having different temperature coefficients or the negative and the positive temperature coefficients of resonant frequency, the mutual temperature dependency to the resonant frquency in the paired dielectric substrates can be cancelled, and thus it is possible to feasibly hold the temperature coefficient of the filter device to zero. As a result, there can be provided a stripline filter which has a characteristic stable with respect to any variation in temperature.

We claim:

1. A microwave stripline filter having a pair of dielectric substrates which are stacked upon each other, each substrate being provided with a ground electrode on the outer surface, and resonator electrodes which are positioned between the stacked surfaces of the substrates and have a predetermined pattern, one of the dielectric substrates being formed by ceramic material having a negative temperature coefficient of resonant frequency, and the other substrate being formed by ceramic material having a composition made up of the same constituents as said one dielectric substrate, the constituents of the other substrate present in amounts such that the other substrate has a positive temperature coefficient of resonant frequency.

2. A microwave stripline filter as claimed in claim 1, wherein said dielectric substrates have substantially same absolute value of temperature coefficient of resonant frequency, whereby the temperature coefficient of resonant frequency of the filter is substantially zero.

3. A microwave stripline filter as claimed in claim 4 wherein said one dielectric substrate has a specific inductive capacity which is substantially the same as the specific inductive capacity of said other dielectric substrate.

4. A microwave stripline filter as claimed in claim 1 having a temperature coefficient of resonant frequency in the range of 0±5 ppm/° C.

* * * * *